US006957030B2

(12) United States Patent
Baker, Jr. et al.

(10) Patent No.: US 6,957,030 B2
(45) Date of Patent: Oct. 18, 2005

(54) METHOD AND APPARATUS FOR MAKING SIGNS

(75) Inventors: Peter R. Baker, Jr., Hebron, CT (US); Mark E. Guckin, Middletown, CT (US); David J. Logan, Monterey, MA (US); Russell F. Croft, Tolland, CT (US)

(73) Assignee: Gerber Scientific Products, Inc., South Windsor, CT (US)

( * ) Notice: Subject to any disclaimer, the term of this patent is extended or adjusted under 35 U.S.C. 154(b) by 0 days.

(21) Appl. No.: 10/360,418

(22) Filed: Feb. 7, 2003

(65) Prior Publication Data

US 2003/0175047 A1 Sep. 18, 2003

Related U.S. Application Data

(60) Provisional application No. 60/354,982, filed on Feb. 8, 2002.

(51) Int. Cl.[7] ..... G03G 15/06

(52) U.S. Cl. ..... 399/222; 399/147; 399/296

(58) Field of Search ..... 156/230, 240, 156/277, 208, 289; 399/147, 222, 296; 430/126

(56) References Cited

U.S. PATENT DOCUMENTS

| | | | | |
|---|---|---|---|---|
| 4,467,525 A | | 8/1984 | Logan et al. | |
| 4,900,597 A | | 2/1990 | Kurtin | |
| 4,919,994 A | | 4/1990 | Incremona et al. | |
| 4,999,076 A | | 3/1991 | Incremona et al. | |
| 5,537,135 A | | 7/1996 | Hevenor et al. | |
| 5,800,655 A | * | 9/1998 | Tokuchi | 156/230 |
| 5,871,837 A | | 2/1999 | Adair | |
| 6,108,022 A | | 8/2000 | Landman et al. | |
| 6,243,120 B1 | | 6/2001 | Hevenor et al. | |
| 6,322,265 B1 | | 11/2001 | Mindek et al. | |
| 6,395,120 B1 | | 5/2002 | Bradbury-Harris et al. | |
| 6,540,345 B1 | | 4/2003 | Wagner et al. | |
| 6,656,306 B1 | | 12/2003 | Mabbott | |
| 6,749,707 B2 | | 6/2004 | Saksa et al. | |

FOREIGN PATENT DOCUMENTS

| | | |
|---|---|---|
| WO | WO 9839166 | 11/1998 |
| WO | WO 03/020519 A1 | 3/2003 |
| WO | WO 03/020519 | 3/2003 |

* cited by examiner

*Primary Examiner*—Hoang Ngo
(74) *Attorney, Agent, or Firm*—Abelman, Frayne & Schwab

(57) ABSTRACT

An apparatus for digitally generating an image comprises a photoconductor assembly, a corona assembly, and a light source assembly to generate a latent image on the photoconductor. The apparatus also includes a developer assembly that includes a developer, such as powder paint, to generate an image. The apparatus may include a fuser for generating a film image. The apparatus of the present invention may include a cartridge for storing and digitally applying adhesive to the image. Furthermore, the apparatus of the present invention includes a controller for selectively controlling voltages to control thickness of the image. Additionally, apparatus may include a consumable sheet to remove excess adhesive from the substrate.

90 Claims, 10 Drawing Sheets

METHOD AND APPARATUS FOR MAKING SIGNS

The present application claims priority from and incorporates by reference U.S. Provisional Application Ser. No. 60/354,982 filed Feb. 8, 2002.

BACKGROUND OF THE INVENTION

1. Technical Field

The present invention relates to an apparatus and method for signmaking and, more particularly, to an apparatus and method for additive signmaking and to an apparatus and method for making durable signs.

2. Background Art

The signmaking industry was revolutionized by technology invented and implemented by Gerber Scientific, Inc. of South Windsor, Conn., a common assignee with the present invention. Several inventions relating to signmaking are described in U.S. Pat. Nos. 5,537,135 and 4,467,525, which disclose an apparatus for printing and cutting signs on sheet material. Such signmaking apparatus includes a computer for storing image data and a printer which, based on the image data, applies colorant onto a vinyl sheet material adhered to a backing sheet. Once the desired image is printed, the sheet material is then transferred to a cutter machine. The cutter cuts through the vinyl sheet material around the contour of the image, leaving the backing sheet intact. Subsequent to the cutting operation, the unwanted vinyl material is removed or weeded from the sheet material. The desired image is subsequently applied to a transfer sheet and then to the final product.

Although the above-described method and apparatus have enjoyed great success and popularity, there are several drawbacks. First, the weeding process results in a significant amount of non-recyclable waste. Additionally, the weeding process is labor intensive and time consuming. Furthermore, the weeding process can reduce the quality of the finished sign, because when the excess vinyl material is weeded, the sign image can become damaged. Additional difficulties associated with transferring the printed sheet material from the printer to the cutter include proper alignment between the printer and the cutter. Moreover, the cutter must be properly calibrated with respect to the printer.

U.S. Pat. No. 5,871,837 to Adair entitled "Method of Fixing an Image to a Rigid Substrate" discloses a method of fixing an image to a rigid substrate coated with a thermally tackifiable coating. More specifically, the patent discloses a process wherein the image is printed onto a transfer film, the image bearing surface of the transfer film is then joined in pressing contact with a thermoplastic coating which has been warmed to a softened or tacky state. Once the thermoplastic coating is cooled to a hard, durable state, the transfer film is removed, leaving the image securely affixed to the rigid substrate. However, the process disclosed in the Adair patent has limited use. The Adair method is not practical, for example, for generating a sign for a car door. More specifically, the whole car door would have to be coated with the tacky material with the image then being transferred onto the coated door. However, once the image is adhered, the image will be surrounded by additional polymer, resulting in background haze around the image. Therefore, although the Adair patent provides an alternative to conventional signmaking, the Adair method is limited and is frequently impractical.

Another shortcoming of conventional signmaking is that the signs are not sufficiently durable for many purposes.

Although automated signmaking has significantly improved the time consuming process of manual signmaking, it is still desirable to further simplify and improve the signmaking process by eliminating the waste resulting from weeding and by generating a more durable image.

SUMMARY OF THE INVENTION

According to the present invention, an apparatus and method for an Additive Signmaking™ Process includes a printer for generating a desired image either on a final substrate or a carrier sheet with the image then being transferred from the carrier sheet onto the final substrate. The generated image is "built up" on the carrier sheet or substrate to form a sign, thereby eliminating the need for the weeding process.

According to one aspect of the present invention, referred to herein as an Adhesive Split Transfer™ Process, the printer initially prints the image onto a carrier sheet. A layer of adhesive is then applied onto the carrier sheet with the image printed thereon. Subsequently, a substrate is joined with the carrier sheet such that the layer of adhesive and image are disposed therebetween. Once the carrier sheet is removed, the image remains adhered to the substrate, completing the Adhesive Split Transfer™ Process. If necessary, the image may be cured onto the substrate for improved adherence. The Adhesive Split Transfer™ Process simplifies the signmaking process by consolidating the printing, cutting and weeding operations that are required by existing methods into a single operation. One advantage of the Additive Signmaking™ Process, in general, and of the Adhesive Split Transfer™ Process, specifically, is that the weeding process is no longer necessary, thus eliminating the waste resulting therefrom, reducing potential damage to the sign, and decreasing labor costs.

According to another aspect of the present invention, an apparatus and method for the Additive Signmaking Process includes a printer adapted to print a durable film image on a substrate. The printer includes a developer subsystem adapted to receive developer such as powder paint or powder toner. The developer subsystem can accommodate either a single or dual component developer. According to another embodiment, the developer subsystem includes multiple developer cartridges that are adapted to receive multiple substances, including, but not limited to powder paint or toner paint, clear coat, and/or adhesive. Using a printer with digitally applied powder paint or toner to form a durable film image revolutionizes the signmaking process. Digital application of powder paint for signs allows fabrication of durable signs without a weeding process.

According to another aspect of the present invention, an apparatus and method for the Additive Signmaking Process includes a printer that allows control of various voltages therein for varying the amount of colorant deposited resulting in changing the thickness of the printed image and in allowing use of different products.

According to a further aspect of the present invention, an apparatus and method for the Additive Signmaking Process includes a printer that allows the digital application of adhesive onto an image, substantially placing an adhesive in register with the image, for subsequent application of the image with adhesive placed thereon. Digital application of adhesive onto an image significantly simplifies the signmaking process. Digital application of an adhesive eliminates the need to use coated sheet material that requires subsequent weeding.

According to a further aspect of the present invention, an apparatus and method for the Additive Signmaking Process includes a printer adapted to receive a substrate for application of images thereon such that the substrate has a predetermined thickness and does not require further transfer of the image therefrom. Alternatively, an image can be generated and placed onto a carrier sheet, such as polyvinylflouride sheet, for subsequent transfer to a substrate. According to another aspect of the present invention, the image is electrostatically transferred onto a sign substrate.

According to a further aspect of the present invention, a layer of adhesive is applied over a substrate. An image is built atop of the adhesive. A consumable sheet is then brought in contact with the substrate to remove excess adhesive, which is still disposed on the substrate, such that once the consumable sheet is separated from the substrate, the image remains on the substrate with the adhesive disposed therebetween.

The present invention introduces the concept of Additive Signmaking™ Process, wherein an image is built on top of a substrate without the need for weeding unnecessary material. The image can be either permanently adhered to the substrate or be temporarily placed on a carrier sheet and subsequently transferred onto a final substrate. The image can be built up with use of a variety of apparatus' and/or methods including, but not limited to, use of different colorants, multiple layers of colorants, clear coating, protective coating and/or adhesive. The present invention also introduces a concept of digitally applying adhesive onto a substrate. Furthermore, the present invention introduces another concept of applying adhesive over the entire substrate, building up an image atop of adhesive, and then removing excess adhesive. Thus, the concepts introduced by the present invention result in improved quality of the final product, as well as savings in time, labor, and materials.

The foregoing and other advantages of the present invention become more apparent in light of the following detailed description of the exemplary embodiments thereof, as illustrated in the accompanying drawings.

DETAILED DESCRIPTION OF THE PREFERRED EMBODIMENT

Figure 1:
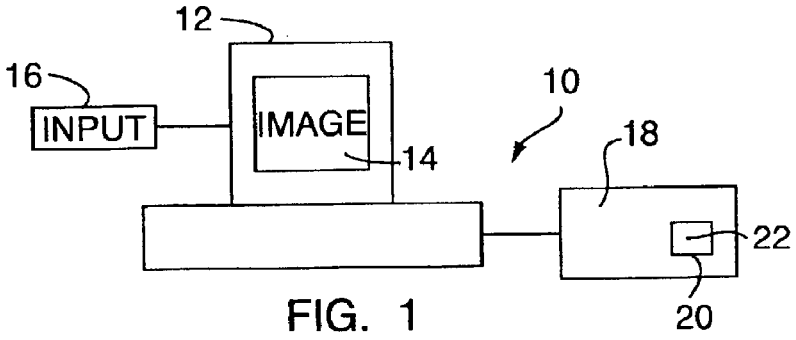
FIG. 1 is a schematic representation of a signmaking system including a computer and a printer.

Referring to FIG. 1, an Additive Signmaking™ System 10 for an Additive Signmaking™ Process, according to one aspect of the present invention, includes a programmable computer 12 for generating an image 14 based on an input data 16. The system 10 also includes a printer 18 which communicates with the computer 12. The printer 18 includes at least one developer cartridge 20 that is filled with developer 22.

Figure 2:
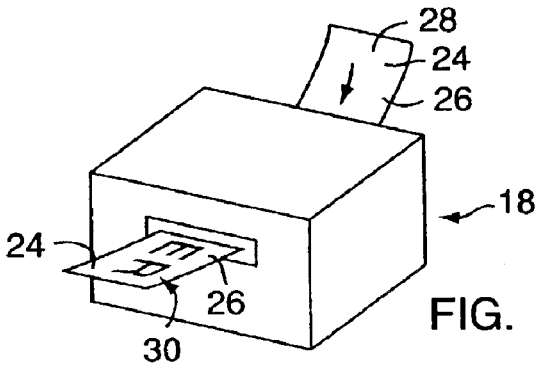
FIG. 2 is an enlarged, simplified, perspective view of the printer of FIG. 1.
Figure 4:
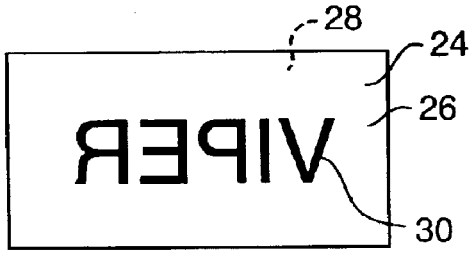
FIG. 4 is a front view of a carrier sheet with an image printed thereon in accordance with the process of FIG. 3.
Figure 5:
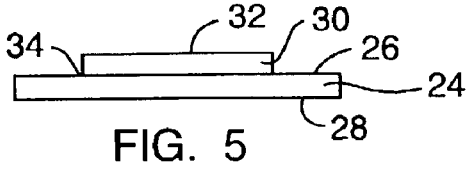
FIG. 5 is a side view of the carrier sheet and the image of FIG. 4.
Figure 6:
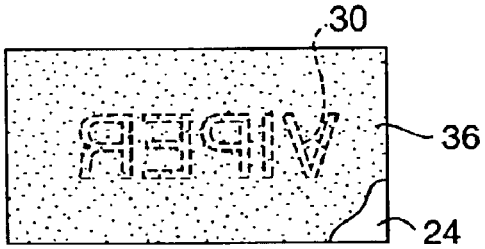
FIG. 6 is a partially broken away, front view of the carrier sheet with the image printed thereon and adhesive, in accordance with the process of FIG. 3.

Referring to FIG. 2, in an Adhesive Split Transfer™ Process, according to one aspect of the present invention, a carrier sheet 24 having a first carrier side 26 and a second carrier side 28 is placed into the printer 18. The printer 18 generates an image 30 having a first image side 32 and a second image side 34, as indicated by A2 in FIG. 3 and best seen in FIGS. 4 and 5. The image 30 is transferred onto the first side 26 of the carrier sheet 24 within the printer 18, as seen in FIGS. 2,4 and 5. In the preferred embodiment of the present invention, the image 30 is reverse printed or a mirror image is printed onto the carrier sheet 24.

Figure 3:
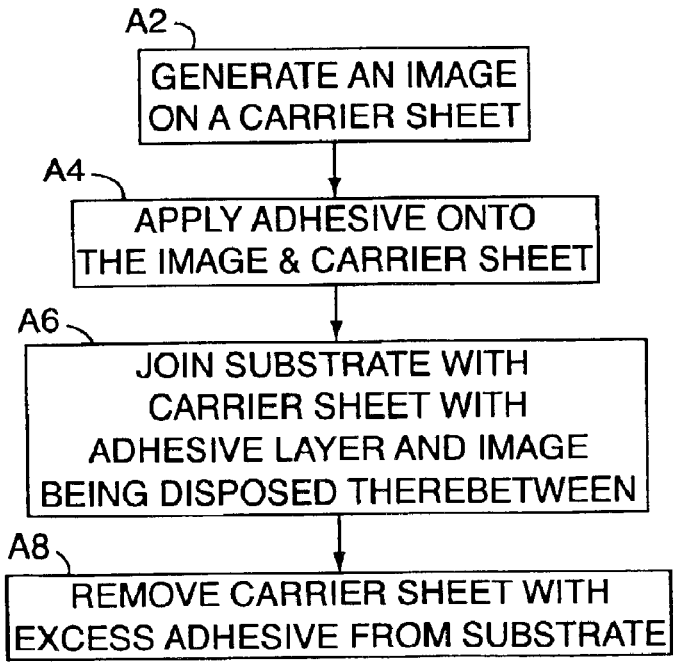
FIG. 3 is a block diagram of a process for printing a sign onto a carrier sheet for subsequent transfer to the final location using the signmaking system of FIG. 1.
Figure 7:
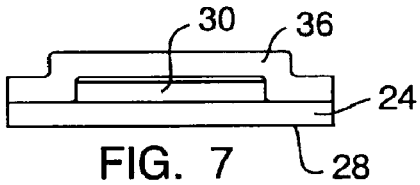
FIG. 7 is a side view of the carrier sheet, the image and the adhesive of FIG. 6.
Figure 8:
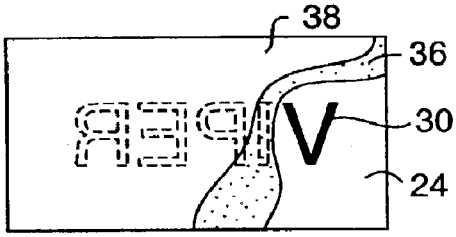
FIG. 8 is a partially broken away, front view of the carrier sheet, the image, the adhesive and substrate, in accordance with the process of FIG. 3.
Figure 9:
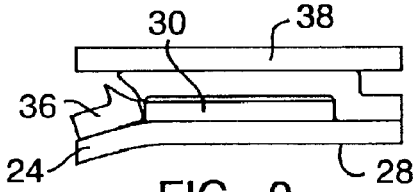
FIG. 9 is a side view of the carrier sheet, the image, the adhesive and the substrate of FIG. 8.
Figure 10:
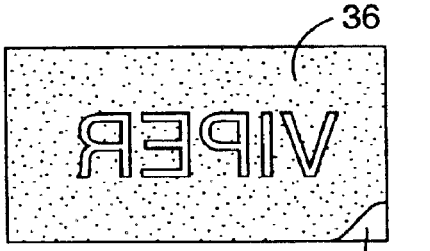
FIG. 10 is a partially broken away, front view of the carrier sheet with excess adhesive, in accordance with the process of FIG. 3.
Figure 11:
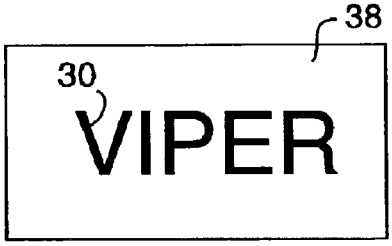
FIG. 11 is a front view of the substrate with the image adhered thereto, in accordance with the process of FIG. 3.

Referring to FIGS. 3, 5 and 7, once the image is printed onto the carrier sheet 24, an adhesive layer 36 is applied onto the first side 26 of the carrier sheet 24 and the first side 32 of the image 30, as indicated by A4 in FIG. 3. A substrate 38 is subsequently joined with the carrier sheet 24 such that the adhesive layer 36 and the image 30 are sandwiched therebetween, as indicated by A6 in FIG. 3 and shown in FIGS. 8 and 9. The substrate 38 and the carrier sheet 24 with the image 30 and adhesive 36 disposed therebetween can be pressed together for the film image 30 to properly adhere to the substrate 38. Then, the carrier sheet 24 is removed from the substrate 38, as indicated by A8 in FIG. 3 and shown in FIG. 9. The adhesive 36 that was in direct contact with the carrier sheet 24 adheres to the carrier sheet and is removed from the substrate 38, as shown in FIG. 10. With the removal of the carrier sheet 24 and excess adhesive 36 from the substrate 38, the film image 30 remains properly adhered to the substrate 38, completing the Adhesive Split Transfer process, as shown in FIG. 11. Optionally, the substrate 38 and image 30 may be additionally cured for improved adherence of the film image onto the substrate. Various curing processes can be used, including but not limited to, ultraviolet light treatment, infrared heating, RF heating and/or conventional heating.

The adhesive 36 can be any type of adhesive, as long as the adhesive has preference for the carrier sheet 24 over the substrate 38. Several different techniques can be used to apply the adhesive. One approach is to use liquid adhesives applied with a wire wrapped drawdown bar. One type of the wire wrapped drawdown bar is manufactured by Paul N. Gardner, Inc. of Pompano Beach, Fla. To obtain the appropriate coverage with the adhesive, the adhesives can be thinned to reduce the surface tension of the adhesive. Examples of such liquid adhesives are Covinax 386™ manufactured by Franklin International, Inc. of Columbus, Ohio and ScotchGrip 4224™ manufactured by 3M Corporation of St. Paul, Minn. In the preferred embodiment, the liquid adhesives were thinned with deionized water and dish soap according to the following composition: 50 ml of adhesive, 50 ml of water, and 5 ml of Joy™ dish soap. Joy™ dish soap is fabricated by Proctor & Gamble of Cincinnati, Ohio. However, numerous other liquid adhesives can be used, as long as the adhesive has preference for the carrier sheet.

Other types of adhesive that can be used are pressure sensitive adhesive films. These films are from a class known as adhesive transfer films, that, include adhesive only, rather than adhesive and some other supporting film. The most commonly used adhesive films are manufactured by Xyron, Inc. of Scottsdale, Ariz. and are applied with the Xyron 850™ laminator, also manufactured by Xyron, Inc.

In the Adhesive Split Transfer Process, there are four (4) important bonds:

1. The bond between the image and the carrier sheet ("Image/Carrier");
2. The bond between the image and the adhesive ("Image/Adhesive");
3. The bond between the adhesive and the carrier sheet ("Adhesive/Carrier"); and The bond between the adhesive and the substrate ("Adhesive/Substrate").

The Adhesive Split Transfer Process will occur when the following set of relationships between the bond strengths exists:

1. The Image/Adhesive bond is stronger than the Image/Carrier bond;
2. The Adhesive/Substrate bond is stronger than the Image/Carrier bond; and
3. The Adhesive/Carrier bond is stronger than the Adhesive/Substrate bond.

Any combination of adhesive, carrier, and substrate that satisfies all three (3) of these relationships may be used for the Adhesive Split Transfer Process. The toner used to generate the image must also satisfy the above-identified relationships.

Therefore, the substrate can be fabricated from any material that allows the substrate, in the non-image area, to release adhesive to the carrier sheet and, in the image area, allows adhesive to bond the film to the substrate. The carrier sheet can be fabricated from any material that will not permanently bond to the image and is preferred over various substrates by the adhesive in the non-image area. In the preferred embodiment, Gerber 220™ vinyl and Gerber 225™ vinyl were used as the carrier sheet. Gerber 220™ vinyl and Gerber 225™ vinyl are products of Gerber Scientific, Inc. of South Windsor, Conn.

The developer can be any type of toner used in standard printers. However, in one embodiment of the present invention, the developer is either a powder paint or a dual component developer comprising ferrite carrier beads and powder paint or powder toner, as discussed in greater detail below. In the preferred embodiment, the dual component developer comprises 80–99% (eighty to ninety nine percent) ferrite carrier beads and 1–20% (one to twenty percent) powder paint or powder toner. However, in the most preferred embodiment, the developer comprises 90–95% ferrite carrier beads and 5–10% powder paint or powder toner. Use of the toner that includes powder paint or powder toner results in the generation of a durable film image. Powder Paint comprises resin and pigment is selected to be outdoor durable and UV stable.

The Additive Signmaking™ Process, in general, and the Adhesive Split Transfer™ Process, in particular, of the present invention simplifies the signmaking process by consolidating the printing, cutting and weeding operations required by conventional methods into a single operation. One advantage of the present invention is that the weeding process is no longer necessary, thus eliminating the waste resulting therefrom, potential damage to the sign during the weeding process, and labor costs therefor. Another advantage is that when powder paint or powder toner is used, the image generated is durable, with the powder paint generated image, the image could withstand outside elements for prolonged period of time. A further advantage of the Additive Signmaking Process and of the Adhesive Split Transfer Process is that there are no limitations on where the signs can be applied. For example, these processes overcome the drawbacks of the U.S. Pat. No. 5,871,837, as discussed in the Background of the Invention section of the present invention.

Figure 12:
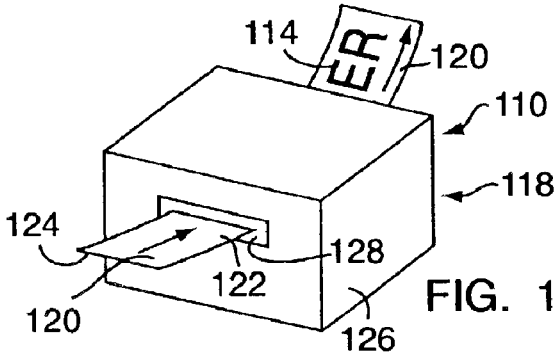
FIG. 12 is a schematic representation of a printer for an Additive Signmaking™ Process, according to another embodiment of the present invention.

Referring to FIG. 12, according to another aspect of the present invention, an Additive Signmaking™ System 110 for generating a durable film image 114 includes a printer 118. The durable film image 114 is essentially "built up" onto a substrate 120, according to the present invention. The substrate 120 has a first substrate side 122 and a second substrate side 124. The printer 118 includes a housing 126 with an input opening 128 for intaking the substrate 120 and an output opening 130 (not shown in FIG. 12) formed therein for allowing egress of the substrate 120.

Figure 13:
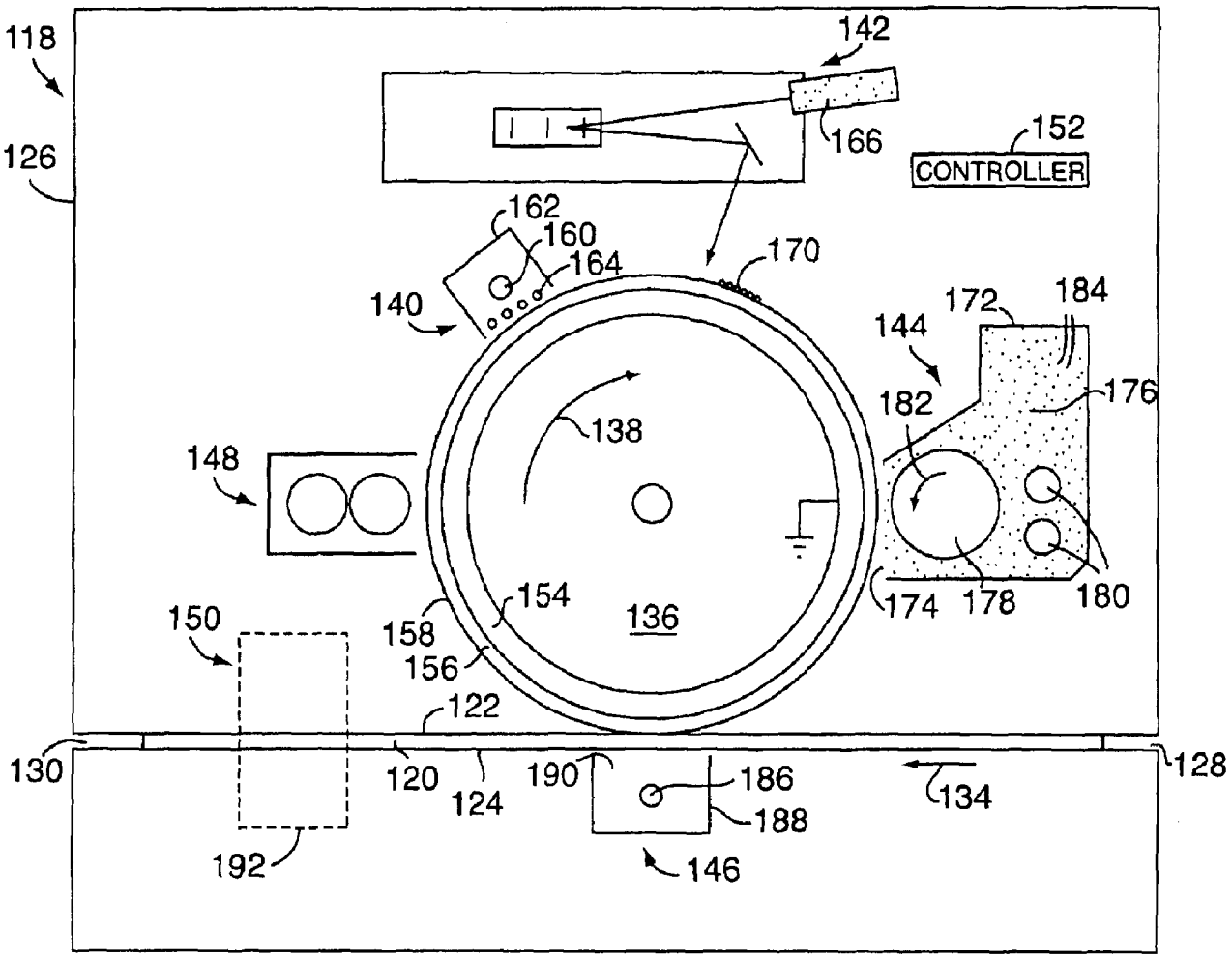
FIG. 13 is a schematic representation of components of the printer of FIG. 12.

Referring to FIG. 13, in one preferred embodiment, the printer 118 is an electrophotographic printer and includes a substrate path 134 extending from the printer intake opening 128 to the printer output opening 130. The printer also includes a photoconductor 136, rotating in a photoconductor rotational direction, indicated by an arrow 138, a charge corona assembly 140, a light scanner assembly 142, a developer subsystem 144, a transfer corona assembly 146, and a cleaner assembly 148 all disposed in proximity to the photoconductor 136. In the preferred embodiment, the printer 118 also includes a fuser assembly 150 disposed downstream from the photoconductor 136 along the substrate path 134. The printer 118 further includes a controller 152.

The photoconductor 136 includes a ground layer 154 and a photoconductive surface layer 156 disposed radially outward of the ground layer 154 to define a photoconductive surface 158, as is known in the art. The charge corona assembly 140 includes a corona wire 160 enclosed within a corona cage 162, that is at ground potential, and a corona screen 164 interposed between the corona wire 160 and the photoconductive surface 158. The corona wire 160 is held at high voltage for generating ions that bombard the photoconductive surface layer 156 with the screen 164 controlling the level of charge that builds on the photoconductive surface layer 156.

The light scanner assembly 142 includes a light source 166 which selectively discharges portions of the photoconductive surface layer 156 to generate a latent image 170 thereon. The light source 166 can be any light source which can include, but not be limited to a laser source, as is used in the preferred embodiment, or an LED source. The selective discharge of the light source 166 is digitally controlled by the controller 152 to generate the latent image 170.

The developer subsystem 144 includes a cartridge 172 that forms a cartridge opening 174 to allow communication with the photoconductor 136. The cartridge 172 houses the developer or toner 176 as well as a developer roller 178, disposed substantially adjacent to the cartridge opening 174, and a plurality of mixers 180. The developer roller 178 is rotated in the developer roller direction, as indicated by an arrow 182, which is typically opposite to the photoconductor rotation direction 138. The mixers or augers 180 are activated to continually mix the developer within the cartridge 172. The developer comprises a plurality of developer particles 184.

The transfer corona assembly 146 is disposed on the opposite side of the substrate 120 from the photoconductor and includes a transfer corona wire 186 housed in a transfer corona housing 188 that has an opening 190 facing the substrate 120.

The fuser subassembly 150 is disposed downstream from the transfer corona assembly 146 along the substrate path 134 and comprises a fuser 192 for fusing and/or curing the image onto the substrate 120. The fuser may be a number of various systems, including, but not being limited to, ultraviolet light, infrared heat, conventional heat, combination of heat and pressure and/or other types of fusing means. However, in the preferred embodiment, it is desirable not to use some of the silicone oils that are typically used in conventional systems to prevent "Hot Offset". The oil used in conventional systems is invariably transferred to the surface of the printed image. This oil now interferes with the bond between the powder toner/powder paint and whatever type of adhesive is applied over it. If the bond between the adhesive and the powder toner/powder paint is not sufficiently strong, the process will be compromised.

Placing the unfused image and carrier sheet in a convection oven for about one minute (1 min.) at approximately 300° F. (three hundred degrees Farenheight) has proven to be satisfactory for fusing powder toner without introducing any silicone oil to the surface of the image. One type of the oven that can be used is a VWR Model 1320 Convection Oven, manufactured by VWR Scientific Products, Inc., Bridgeport, N.J.

This fusing process is also a preferred embodiment for the Adhesive Split Transfer Process described above.

The cleaning subassembly 148 is disposed substantially adjacent to the photoconductor 136 to clean the photoconductive surface 158 for accepting a subsequent image.

Figure 14:
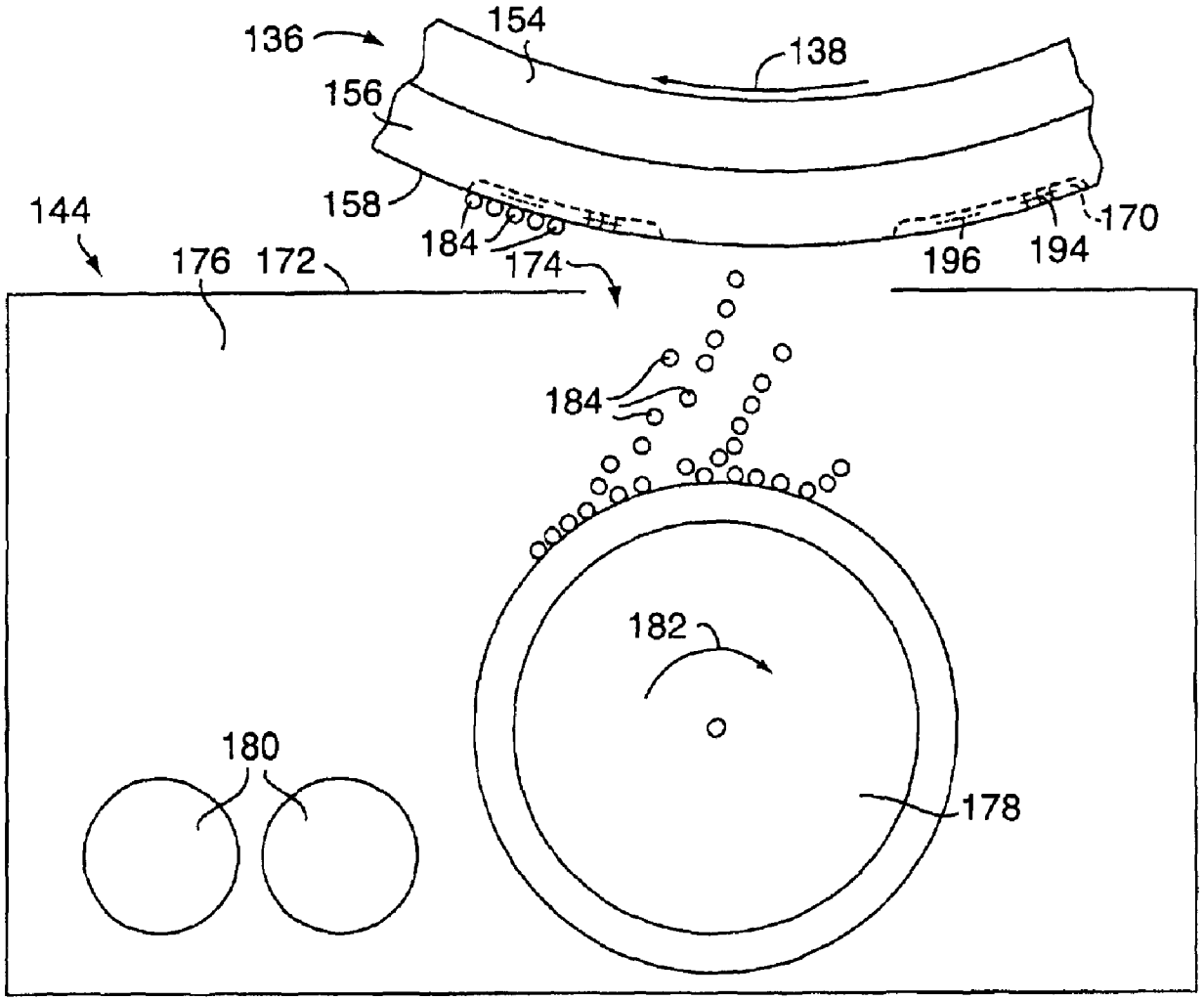
FIG. 14 is a schematic representation of one embodiment of a developer subsystem of FIG. 13.

In operation, the charge corona assembly 140 generates a substantially uniform charge on the photoconductive surface layer 156. Subsequently, as the photoconductor 136 is rotated in the photoconductor rotational direction 138, the light source 166 selectively discharges portions of the photoconductive surface layer 156 to digitally generate a latent image 170 of a final product. The resultant latent image 170 comprises a "background" portion 194 which has an original corona charge and an "image" portion 196, that has been digitally generated by the light source 142, having an image charge, as shown in FIG. 14. However, the "image" portion can have the original corona charge and the "background" portion could be digitally discharged by the light source.

As the latent image 170 is generated, the photoconductor 136 is further rotated, toward the developer subsystem 144, and the latent image 170 is developed by selectively attracting developer particles 184 of the developer 176 disposed in the developer subsystem.

Referring to FIG. 14, the developer 176, having a predetermined developer charge is attracted to the latent image 170. More specifically, the developer is charged such that the developer particles 184 are attracted to the image portion 196 of the latent image 170 and not to the background portion 194 of the latent image. Alternatively, a developer with a developer charge opposite in sign to the predetermined developer charge can be attracted to the background portion of the latent image. Although it is shown in FIG. 14 that the background portion 194 of the latent image 170 has a positive charge and the image portion 196 has a negative charge, the opposite is within the scope of the present invention. The exact charge of each portion is not critical as long as one portion of the image attracts toner particles and the other portion does not.

Figure 15:
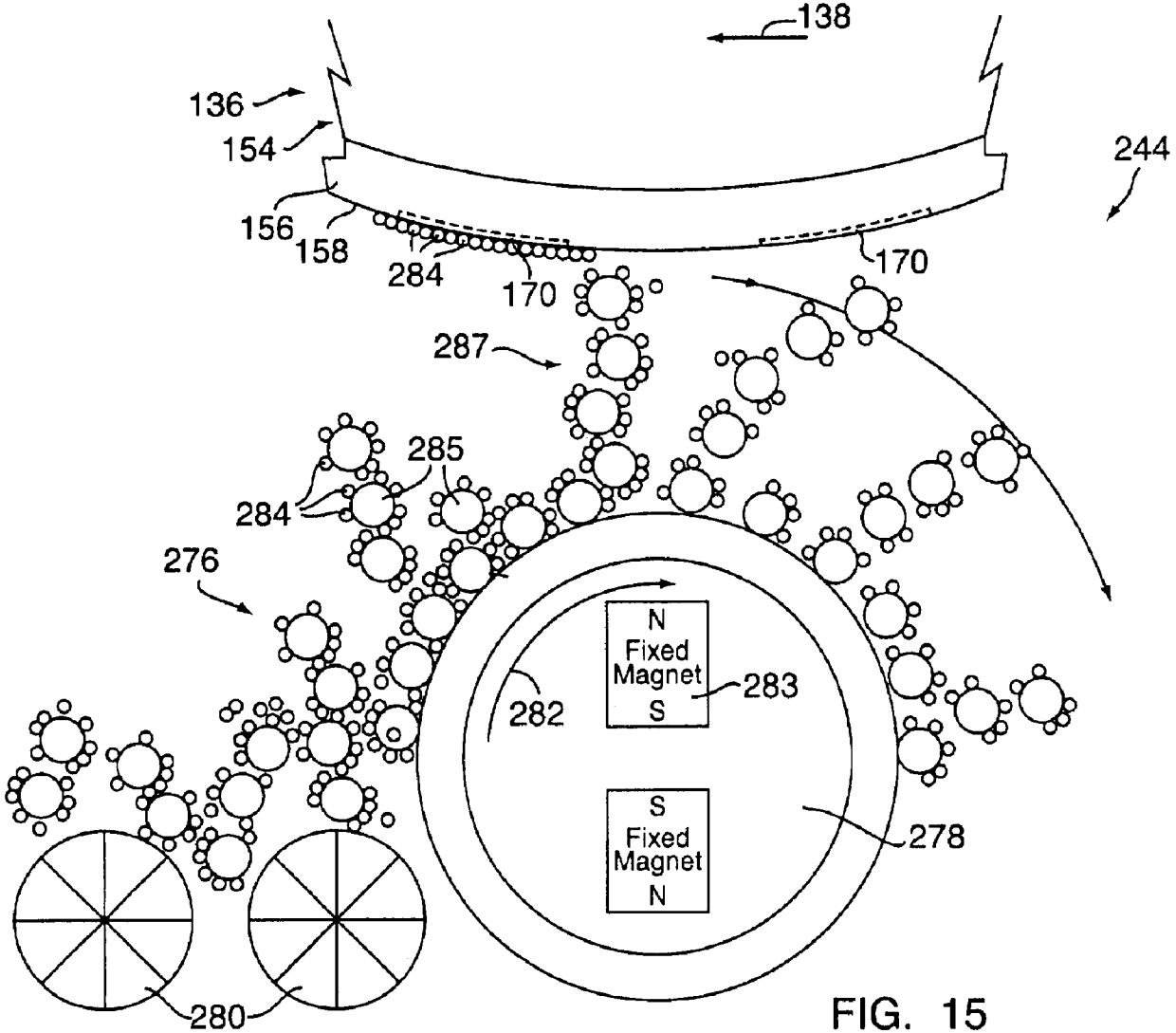
FIG. 15 is a schematic representation of another embodiment of a developer subsystem of FIG. 13.

Referring to FIG. 15, the developer subsystem 144 can be also a dual component developer system 244 that includes a developer roller 278 rotating in the developer roller direction 282 and a plurality of mixers or augers 280 and dual component developer 276. The developer roller 278 includes at least one magnet 283. The dual component developer 276 comprises a plurality of toner particles 284 and a plurality of carrier particles 285. The carrier particles, in the preferred embodiment of the present invention, are ferrite particles of approximately 10–100 microns ($\mu$m) diameter that have been coated with a polymer. One type of carrier particles used was Teflon™ coated ferrite powder (Type 13) fabricated by Vertex Image Products, Inc. of Yukon, Pa. However, other types of carrier particles can be also used. In the preferred embodiment of the present invention, the toner particles are either toner paint or powder paint. The size of the toner or powder paint particles is smaller than the size of the carrier particles. The toner particles must also have the ability to be triboelectrically charged by the surface coating of the carrier powder when the carrier powder and the toner particles are mixed together.

In operation, the carrier particles 285 and the toner particles 284 are mixed within the dual component developer system. The magnet generates a brush 287 of the toner/carrier mixture. The developer roller 278 is held at a voltage that generates a field between the developer roller and the latent image 170 which has been formed on the photoconductor 136. The generated field strips the toner particles 284 away from the carrier particles 285 and deposits them on the photoconductor 136, developing the latent image 170 into the film image.

According to one aspect of the present invention, the controller 152 allows variable control over the voltages of the first corona screen 164, the developer roller 178, and the transfer corona 146, as seen in FIG. 13. In one example, the corona screen voltage was set to be between −100 volts and −1500 volts. The developer roller voltage was set to be approximately −1000 volts. The transfer corona voltage was set to be between −3,500 volts and −6,000 volts. Two types of voltage differences were set up in the dual component developer system to control the quality of the final image. The first voltage difference was defined between the image portion of the latent image and the developer roller 178. As an example, the charge corona screen voltage set the photoconductor charge to be between −100 volts and −1,500 volts. The laser then discharges the background portion of the latent image, leaving the image portion of the latent image at some voltage between −100 volts and −1,500 volts. The dual component developer imparts a positive charge on the powder paint particles. The developer roller voltage sets up an electrical field between the developer roller 178 and the image portion on the photoconductor. The strength of the field is determined by the difference between the charge corona screen voltage and the developer roller voltage. The more negative the charge corona screen voltage, and thus the image portion voltage, with respect to the developer roller voltage, the greater the force compelling the positively charged powder paint particles to transfer to the image portion. Voltages can vary and be opposite in sign for different system setup and/or powder paint.

The second voltage difference is defined between the background portion on the photoconductor, which has been discharged to near ground by the laser, and the developer roller. To avoid development of the background portion by the powder paint, it has been found that it was important to keep the potential of the developer roller below ground. In the preferred embodiment, the setting for the best image was with the corona screen being at approximately −1,200 volts and the developer roller at approximately −300 volts, thereby generating an approximately 1,500 volt difference between the developer roller and the image portion and an approximately 300 volt difference between the developer roller voltage and the background portion of the latent image.

The ability to vary the voltages at key points in the system also contributes to control of the amount of powder paint being deposited on the photoconductor and therefore, on the thickness of the resultant film image.

Figure 16:
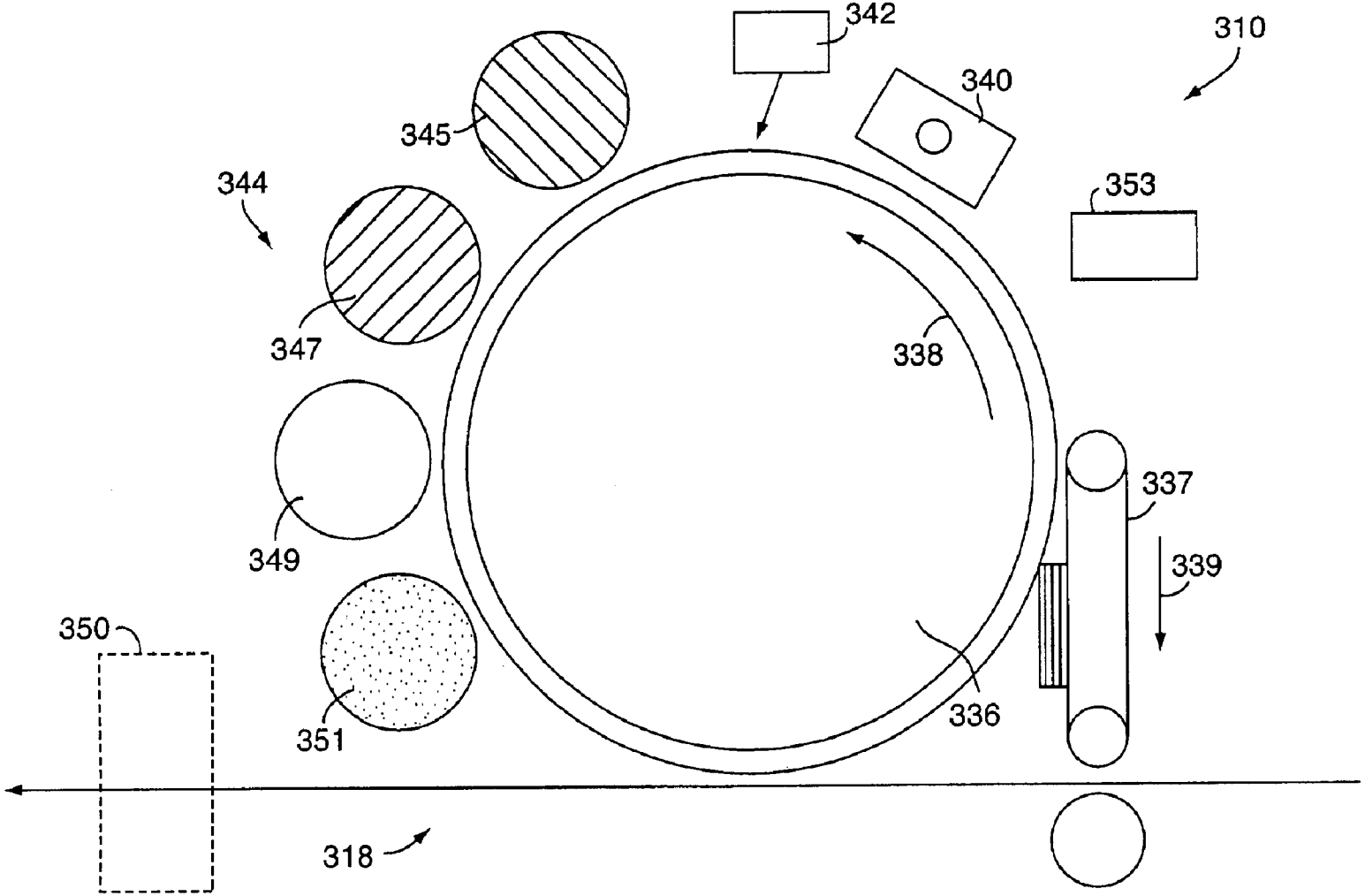
FIG. 16 is a schematic representation of another embodiment of components of the printer of FIG. 12.

Referring to FIG. 16, according to another aspect of the present invention, an Additive Signmaking System 310 includes a printer 318 that is substantially analogous to the printer 118 described herein and depicted in FIG. 14. However, printer 318 includes a plurality of developers 344 disposed sequentially in close proximity to the photoconductor 336. The printer 318 also includes an intermediate transfer belt 337 that is movable in a transfer belt direction 339 which is opposite to the photoconductor rotation direction 338. The photoconductor 336, the charge corona 340 and the light source 342 of the printer 318 are substantially similar to that of the printer 118. However, the developers 344 include various substances that are digitally applied onto the photoconductor 336, transferred to the intermediate transfer belt, and subsequently transferred onto a substrate. In one embodiment of the present invention, the first developer 345 includes powder paint or powder toner. The second developer 347 includes a different color of powder paint or powder toner. The third developer 349 includes a clear coat to deposit dear film onto the substrate. The fourth developer 351 includes an adhesive to be digitally applied through the photoconductor and the intermediate transfer belt onto the substrate.

In operation, the latent image first would be developed by attracting the toner or powder paint, as discussed above. The latent image with the powder paint would then be transferred onto the intermediate transfer belt, as a first image portion. Subsequently, another latent image could be developed with colored powder paint as a second image portion and transferred onto the intermediate transfer belt to be substantially in register with the first image portion. Subsequently, the clear coat from the third developer system would be applied to a third latent image as a third image portion which would be then transferred again onto the intermediate transfer belt to be subsequently in register with the first and second image portions. Furthermore, with the first, second and third developer systems being inactivated, the fourth developer would digitally apply adhesive onto the photoconductor's latent image as a fourth image portion which then would be transferred onto the intermediate transfer belt to subsequentially overlap with the first, second and third image portions of the film image. The multiple image portions from the intermediate transfer belt would then be transferred onto the substrate.

This process would result in "building up" of the final film image comprising multiple layers. The types of layers and order of application of the layers could vary depending on particular requirements of the final film image product. The thickness of each layer can also vary from product to product as the voltages within the printer can be varied, as discussed above.

According to a further aspect of the present invention, the adhesive is digitally applied to either the first surface of the carrier sheet or the first image side of the film image. Adhesive is applied to areas where the film image has been or will be created. Digital application of the adhesive may be achieved through several techniques including electrophotography of a heat and/or pressure activated powdered adhesive, ink jetting of a liquid adhesive, or thermal transfer of a dry film adhesive. The digitally applied adhesives may be heat sensitive, pressure sensitive, or UV sensitive. One such type is Hot Melt powder adhesive manufactured by Union, Inc., Ridgefield, N.J. A protective film can be applied to cover the adhesive which is removed just prior to the application of the durable film image to the final substrate, or the printer may apply the adhesive to the carrier sheet prior to creation of the film image. The adhesive and the film image may then be lifted from the carrier sheet with transfer tape and applied to the final substrate, as is typical in traditional signmaking.

According to an additional aspect of the present invention, the adhesive contains colorant and has a dual purpose of an adhesive and a colorant. The colorant can be either pigment or dye.

Figure 17:
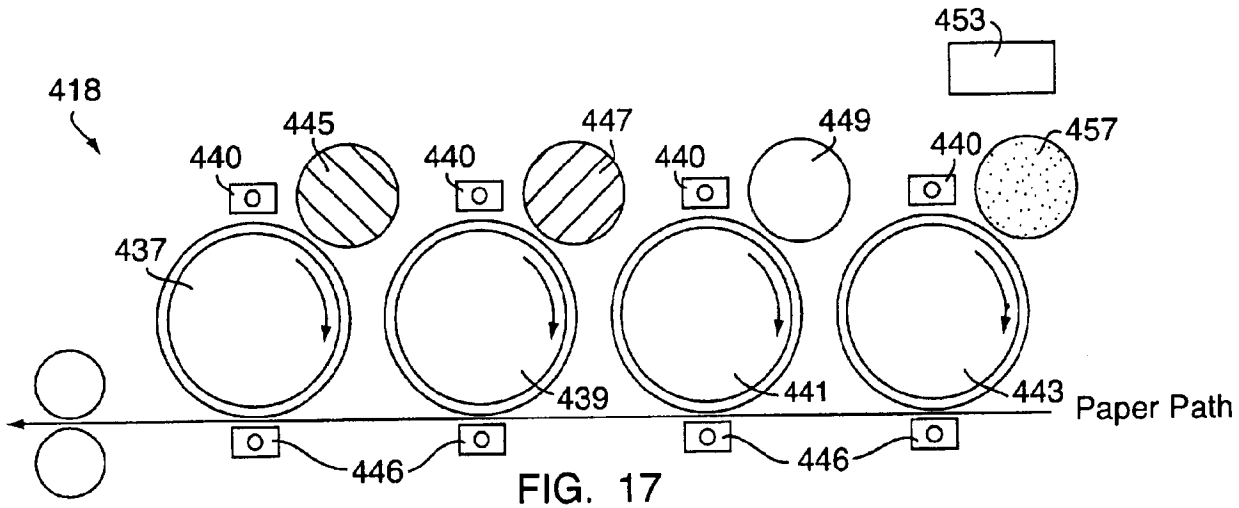
FIG. 17 is a schematic representation of a further embodiment of components of the printer of FIG. 12.

Referring to FIG. 17, although a multiple developer system 318, described above, included a single photoconductor 336 and a plurality of developers 345, 347, 349 and 351, system 418 may include a plurality of developers 445, 447, 449 and 457 corresponding to a plurality of photoconductors 437, 439, 441 and 443. Each photoconductor would have a corresponding charge corona 440 and a transfer corona 446. The image would be "built up" in a manner described above and include a plurality of digitally applied layers of developers, coatings and/or adhesive housed within the developers 445, 447, 449 and 457.

Figure 18:
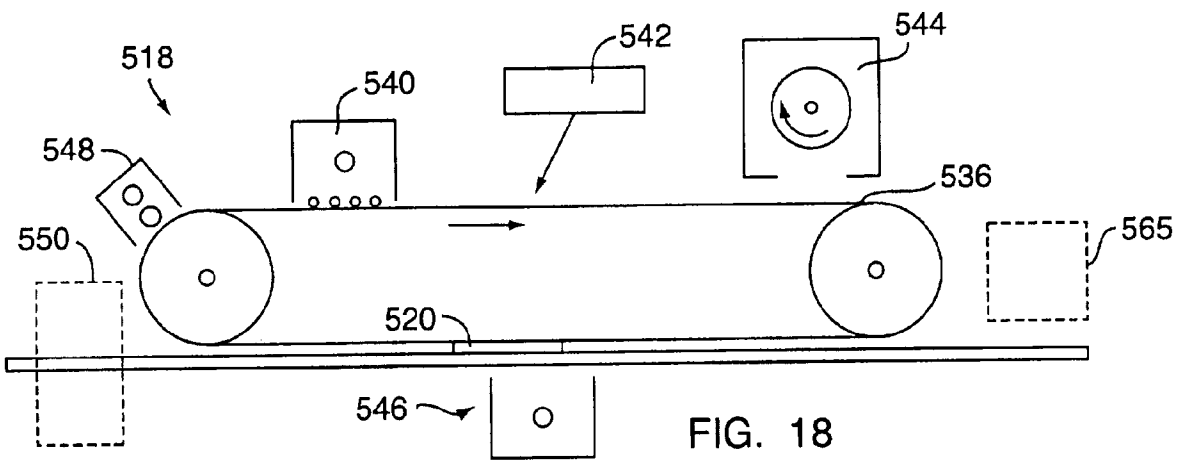
FIG. 18 is a schematic representation of a further embodiment of components of the printer of FIG. 12.

Referring to FIG. 18, although the photoconductors 136, 336 have been described as a drum rotating in a photoconductor rotational direction 138, 338, respectively, the photoconductors 136, 336 can be a photoconductor belt 536 with the printer 518 having substantially the same structure and functionality.

Additionally, although some systems include means for digital application of adhesive, in accordance with the teachings of the present invention, as discussed above, some systems may require means for applying adhesive 565, shown in FIG. 18, wherein the means 565 is adapted to apply adhesive either digitally or globally over the entire substrate.

Referring to FIGS. 16 and 17, a voltage subassembly 353 and 453 is included in the printers 318, 418, respectively. The voltage subassembly 353, 453 controls voltage within the printer and thereby allows use of various types of materials in the same printer. For example, protective coating, adhesive and various types of colorants can be used within the same apparatus. Additionally, the voltage assembly allows the generated image to have varying thickness, as discussed above.

Because of the wide variety of materials that may be used during printing with the Additive Signmaking Process, including, but not limited to: powder toner, powder paint, clear coat, and powdered adhesive, it is important to have the ability to use a single imaging system to image both positive or negative charging powders.

As discussed above, the charge corona system imparts a uniform negative charge on the surface of the photoconductor. Subsequently, areas of the photoconductor that are exposed to light from the light source are discharged to approximately ground. This process generates areas with two distinct levels of charge. Positive charging powders will be attracted to the areas of the photoconductor that remain at the original level of charge and negatively charged powders are attracted to the discharged areas of the photoconductor. When a positive charging powder is to be imaged, the light source is used to discharge the "negative" of the image data. The powder is then attracted to areas of the photoconductor that have not been discharged by the light source. A potential more negative than the original charge level of the photoconductor is then used to transfer the powder from the photoconductor to an intermediate roller or the carrier sheet. When a negative charging powder is to be imaged, the light source is used to discharge the "positive" of the image data. The powder is attracted to the areas of the photoconductor that have been discharged by the light source. A potential more positive than the discharged level of the photoconductor is then used to transfer the powder from the photoconductor to an intermediate roller or the carrier sheet.

The voltage subassembly 353, 453 accomplishes both of these tasks. In the best mode, Trek 610D High Voltage Supplies fabricated by Trek Inc. of Medina, N.Y. were used to control the transfer potentials in the printer. For negative charging powders, the intermediate transfer roller voltage was set to +350V and the final transfer roller voltage was set to +1,200V. For positive charging powders, the intermediate transfer roller voltage was set to −950V and the final transfer roller voltage was set to −2,00V.

Figure 19:
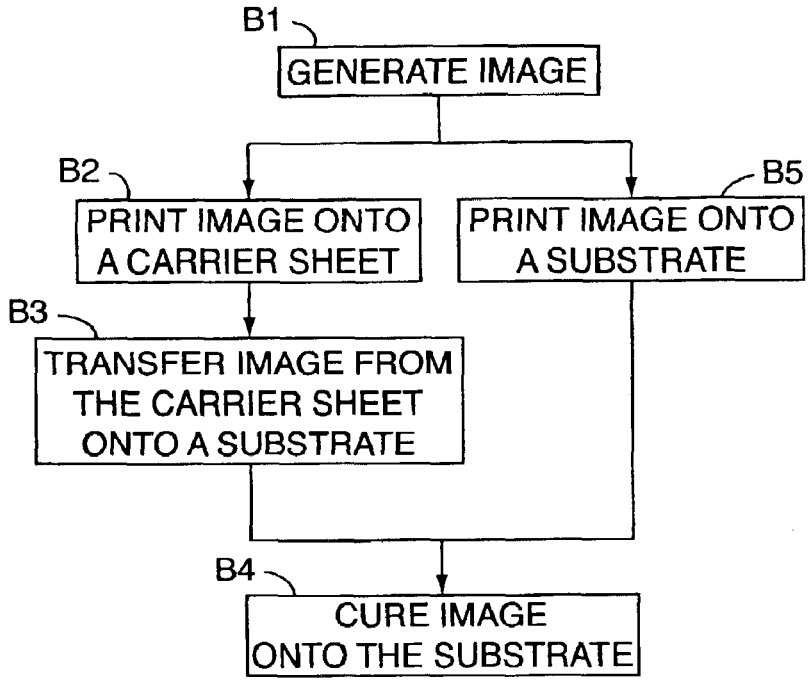
FIG. 19 is a block diagram of a process for printing a sign onto a substrate using the signmaking system of FIG. 1.
Figure 20:
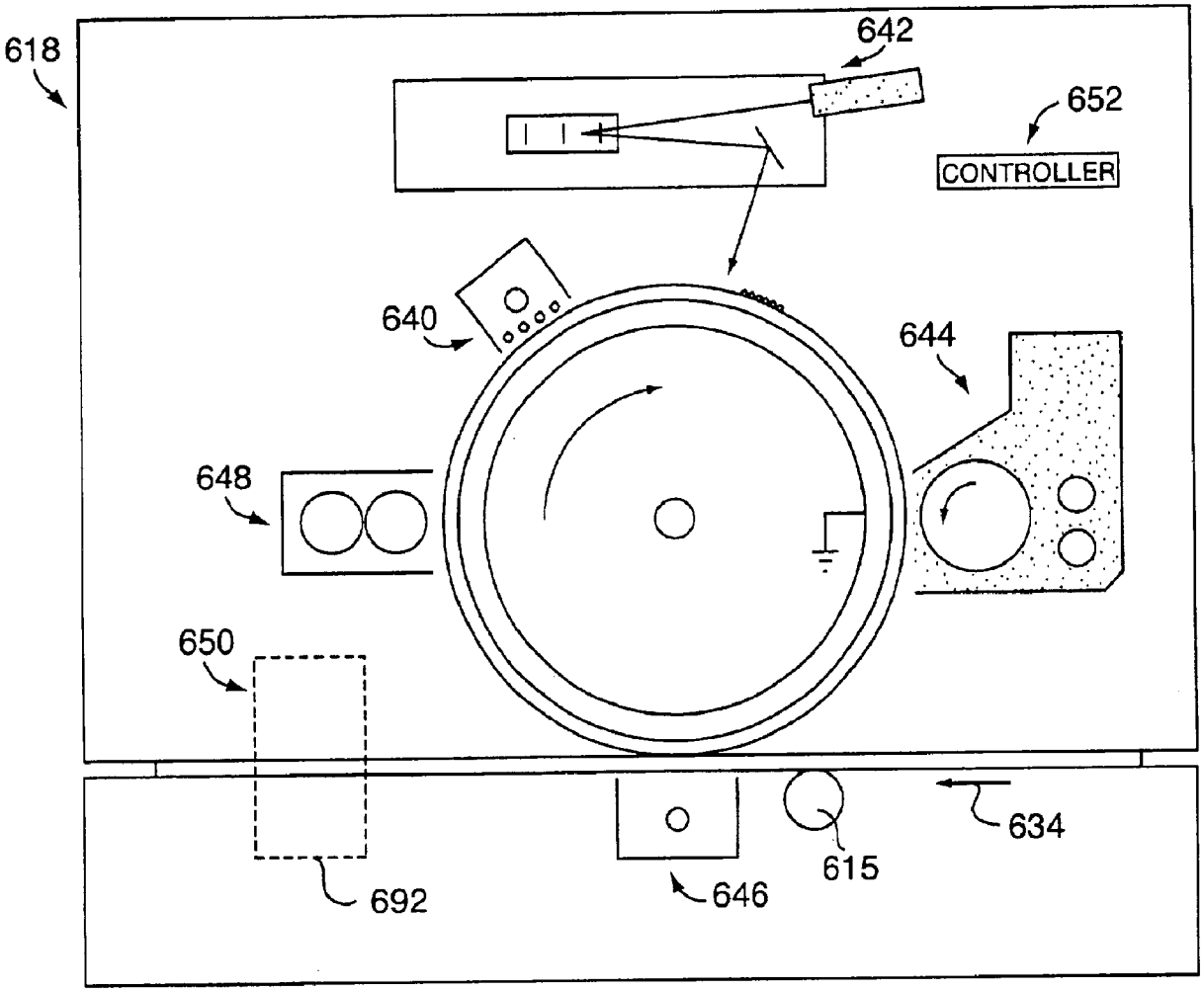
FIG. 20 is a schematic representative of an apparatus for generating a sign.

Referring to FIGS. 19 and 20, according to another aspect of the present invention, in a system 618, substantially analogous to system 118 shown in FIG. 13, a sign such as, for example, a road sign or a car door is generated. There are several methods for generating a final sign. In accordance with one method of the present invention, the input data pertaining to an image is communicated to the computer and printed onto a sheet 620. In one embodiment, the sheet 620 is a transfer or carrier sheet, as indicated by B1 and B2 of FIG. 19. In the preferred embodiment of the present invention, the transfer or carrier sheet is fabricated from polyvinylfluoride (PVF) material. It is preferable to reverse print the image for subsequent transfer. The unfused image is then electrostatically transferred to a sign substrate, as indicated by B3. Support 615, such as a roller, disposed on the backside of the polyvinylfloride sheet 620 is held at approximately ground and the sign substrate, to which the image will be transferred, is held at approximately negative two thousand volts (−2,000V). Subsequently, the image is cured at approximately three hundred degrees Fahrenheit (300° F.) for approximately ten minutes (10 min.), as indicated by B4 in FIG. 19, to form a film image. Voltages can vary in sign and value depending on the properties of the powder paint or toner.

According to another method of generating a sign, the sheet 620 is a sign substrate with the image being generated directly onto the sign substrate, as indicated by B1 and B5 of FIG. 19, with the system 618 being adapted to receive the sign substrate for processing. The image is subsequently cured onto the sign substrate either within the apparatus by means 650 or subsequently outside of the system 618.

The sign substrate is preferably a substantially flat plate such as a roadway sign or a car body or door. The sign substrate may be fabricated of any material that does not attenuate the electric field between the surface of the sign substrate and the surface of the PVF sheet to the point where it is insufficient to force the transfer of the powder from the surface of the PVF sheet to the surface of the sign substrate. Metals and conductive plastics work well, thin non-conductive materials may also be used. In the-preferred embodiment of the present invention, an electrophotographic process was used to generate the image. However, other methods and systems can be used to generate the desired image. One type of a developer that can be used is developer mixture of polyester powder coating from Morton Powder Coatings, Inc. owned by Rohm & Haas Company of Philadelphia, Pa. and flouropolymer coated ferrite from Vertex Image Products, Inc. of Yukon, Pa. In one embodiment, the dual component developer comprises 80–99% (eighty to ninety nine percent) ferrite carrier beads and 1–20% (one to twenty percent) powder paint or powder toner. However, in the most preferred embodiment, the developer comprises 90–95% ferrite carrier beads and 5–10% powder paint or powder toner. However, other developer mixtures can be used, either single or dual component.

Referring to FIGS. 21–24, in accordance with another embodiment of the present invention, the Additive Signmaking™ Process can be implemented by building up an image 729, 829, 929 on a carrier sheet 724, 824, 924 with an adhesive layer 730, 830, 930 disposed therebetween such that the adhesive layer has been pre-applied to the carrier sheet and excess adhesive 731, 831, 931 is subsequently removed from the carrier sheet. Thus, an adhesive layer 730, 830, 930 is initially applied onto a carrier or release sheet 724, 824, 924. A colorant 728, 828, 928 is subsequently applied onto the adhesive layer 730, 830, 930 to built an image 729, 829, 929 on top of the adhesive layer. The image adheres to the carrier sheet by means of the adhesive layer, now sandwiched therebetween. The portions of the carrier sheet without the image still have exposed adhesive portion or excess adhesive 731, 831, 931. A consumable sheet is then brought into contact with the carrier sheet and into direct contact with the excess adhesive 731, 831, 931 and with the image. The excess adhesive adheres to the consumable sheet 839, 939. When the consumable sheet is removed, the adhesive splits along the borders or the perimeter of the image, removing the unwanted portions of excess adhesive and leaving the previously printed image backed by the remaining adhesive on the carrier sheet.

Figure 21:
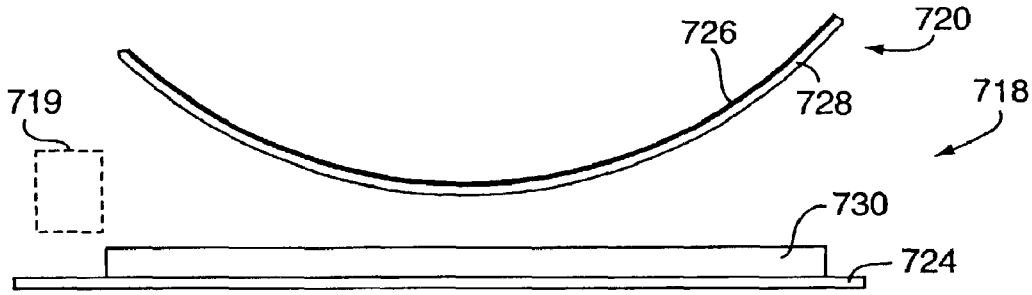
FIG. 21 is a schematic representation of a side view of a carrier sheet with an adhesive layer to be engaged by an ink foil.
Figure 22:
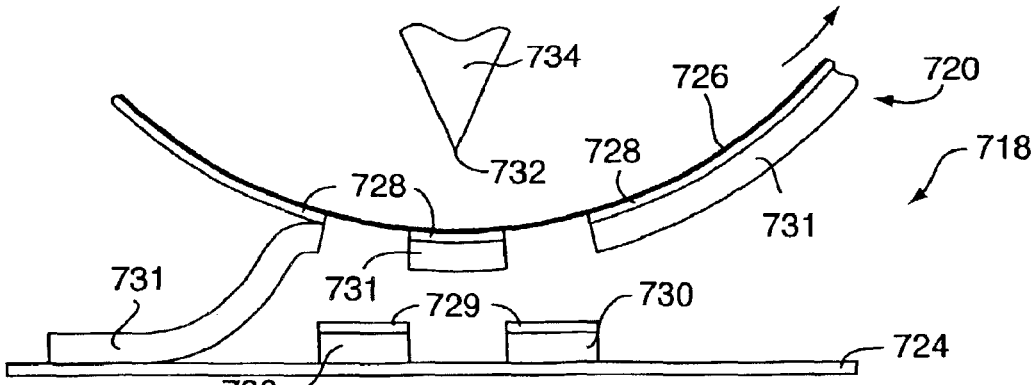
FIG. 22 is a schematic representation of the side view of the carrier sheet after engagement with the ink foil of FIG. 20.

Referring to FIGS. 21 and 22, in one embodiment, a thermal printer 718 is used to generate an image. In the preferred embodiment, a MAXX™ system has been used. The MAXX™ system is a signmaking apparatus manufactured by Gerber Scientific Products, Inc. of South Windsor, Conn., an assignee of the present invention. The MAXX™ system is described in U.S. Pat. Nos. 6,243,120 and 6,322,265, with their disclosures being incorporated herein by reference. However, other thermal printers can be used. As is well known in the art, a thermal printer or signmaking apparatus includes a thermal printhead that comes into contact with an ink foil to generate an image on a substrate.

Referring to FIG. 21, in a thermal system 718, an ink foil 720 comes into contact with an adhesive layer 730 disposed on a carrier sheet 724. The ink foil 720 comprises a foil 726 with resin 728 disposed thereon. As is known in the art, resin or colorant 728 is subsequently separated from the foil to generate an image 729. In the preferred embodiment of the present invention, the release or carrier sheet 724 is coated with the adhesive layer 730 and is placed into the thermal printer with the adhesive layer 730 facing the ink foil 720. In this embodiment, the ink foil 720 also serves as a consumable sheet.

In operation, referring to FIG. 22, as the thermal system 718 selectively energizes printing elements 732 of a thermal printhead 734 that come into contact with the carrier sheet 724 with the foil 720 and the adhesive layer 730 disposed therebetween to generate an image, the resin 728 that is disposed substantially below the energized printing elements 732 is transferred from the foil 720 onto the carrier sheet 724, atop of the adhesive layer 730, thereby printing the image 729 onto the adhesive layer 730 of the carrier sheet 724. Excess adhesive 731 or portions of the adhesive layer 730 that do not have resin 728 disposed atop thereof, adhere to the resin remaining on the foil 720 and are, thereby, removed from the carrier sheet 724 and rolled onto the takeup roll (not shown) with the used foil. Thus, when the printing of the image 729 is completed, the carrier sheet 724 is free of exposed or excess adhesive 731 except in the area of the image, and includes the image disposed thereon with the adhesive layer sandwiched between the carrier sheet and the image. Subsequently, the image can be transferred with transfer tape onto its final location. Optionally, the carrier sheet with the adhesive layer and the image can be cured.

The adhesive layer 730 can be either preapplied onto the carrier sheet or applied internally within the system 718 by an adhesive application means 719.

The release or carrier sheet 724, adhesive 730, and foil 720 can be a variety of products. However, the carrier sheet must allow the release of adhesive with the adhesive having a preference for the foil over the carrier substrate and with resin having a preference for the adhesive over the foil when the foil is in contact with the energized printing element. In the preferred embodiment, polymer coated paper, such as the backside of the carrier used with Gerber Quantum 4000™ vinyl, a product of Gerber Scientific, Inc. of South Windsor, Conn., was used. One type of adhesive is Covinax 386™, manufactured by Franklin International, Inc. of Columbus, Ohio. Any type of ink foil can be used.

Figure 23:
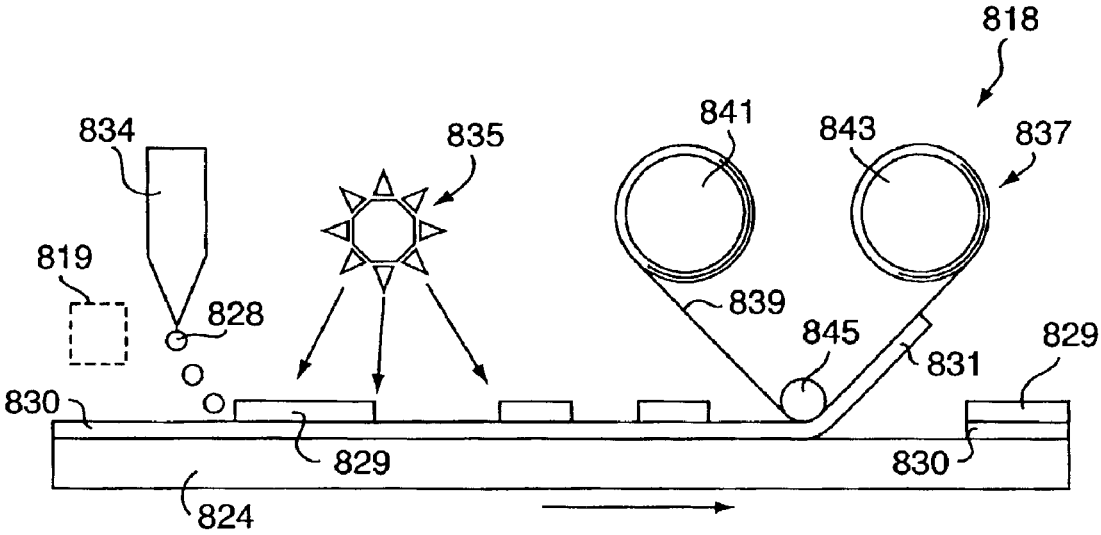
FIG. 23 is a schematic representation of an apparatus for generating signs.

Referring to FIG. 23, in another embodiment for this printing technique, an ink jet system 818 is used to apply ink or colorant 828 to form an image 829 over the pressure sensitive adhesive film 830. The ink jet system 818 is either adapted to receive a carrier sheet 824 with adhesive 830 applied or to apply adhesive 830 to the carrier sheet 824 by adhesive application means 819. The ink jet system 818 also includes at least one ink jet print head 834 to dispense ink 828 to form the image 829 atop the carrier sheet with the adhesive layer 830 disposed therebetween. The ink jet system 818 further includes a curing station 835 for curing ink onto the carrier sheet 824. The curing station 835 can provide any type of curing, including UV cure lamp, infrared, laser, thermal and/or others. The ink jet system 818 also includes means for removing excess adhesive 837. The means for removing excess adhesive 837 includes a consumable sheet 839 that contacts the carrier sheet with the image and excess adhesive thereon such that upon separation of the consumable sheet and the carrier sheet, the excess adhesive 831 remains on the consumable sheet 839 and the carrier sheet 824 or substrate has the image disposed thereon with the adhesive 830 disposed therebetween.

In one embodiment, the means for removing excess adhesive 837 is a consumable sheet, such as foil, rolled on a supply roll 841 with the foil being dispensed from the supply roll and taken up by a take up roll 843. A pressure roller 845 is disposed between the supply roll and the take up roll. The pressure roller acts on the back side of the foil to apply a substantially uniform pressure which promotes the desired adhesive bonding between the foil 839 and the exposed, unwanted adhesive 831. The take up roller acts to peel and store the foil and the excess adhesive. After the foil and unwanted adhesive have been removed, the release or carrier sheet 824 is free of the excess adhesive except where the adhesive exists underneath the printed image.

The non-contact nature of ink jet printing is desirable because it simplifies the problems associated with handling the adhesive coated carrier sheet. UV cure inks are desirable because they are 100% solids (during the UV cure process, 100% of the liquid ink is converted to solid polymer) and will form a film over the adhesive when printed. Traditional water-based or solvent-based inks will not form a solid film upon drying and, therefore, may not provide sufficient structure for blocking of the adhesive. Phase change inks where the colorant is disbursed in wax are also 100% solid and will form a film over the adhesive. For sign making applications, the UV cure inks are generally preferred over phase change inks because they provide a more durable image.

Figure 24:
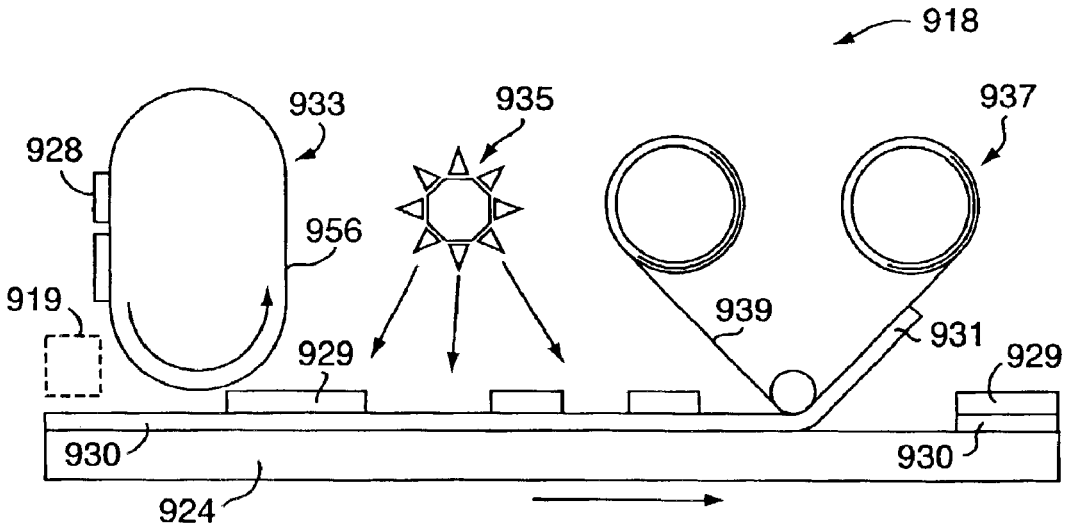
FIG. 24 is a schematic representation of an another embodiment of an apparatus for generating signs.

Referring to FIG. 24, in a further embodiment of the present invention, an electrophotographic system 918 includes means for electophotographically generating an image 933, means for fusing 935, and means for removing excess adhesive 937. The system 918 may or may not include means for applying adhesive 919, as discussed above. The means for electophotographically generating an image 933 can have various configurations, some of which are described above and shown in FIGS. 13–18. Thus, the means for electrophotographically generating an image 933 builds a single or multiple color powder image on a photoconductor roller or belt or a final transfer roller or belt 956. The image is then electrostatically transferred onto the adhesive layer 930 disposed atop of the carrier or release sheet 924. The imaged powder toner or powder paint 928 is subsequently fused into a film image 929 disposed atop of the carrier sheet with the means for fusing 935. The carrier sheet 924 with the fused image 929 and excess adhesive 931 still disposed thereon is brought into contact with the consumable sheet 939 of the means for removing excess adhesive 937. In the embodiment shown, the means for removing excess adhesive is substantially analogous to the means shown in FIG. 23 and described above.

The powder paint or powder toner materials 928 used for imaging in the electrophotographic systems described above form a solid film that can be either used as a sign on the carrier sheet or subsequently transferred onto a final substrate.

For the embodiments describing removal of excess adhesive, it is not necessary to remove the consumable sheet 839, 939 in the printer. Rather, it may be desirable to leave the consumable sheet atop the carrier sheet and the excess adhesive as a protective layer to be removed at the time of application to the final substrate.

For multi-color printing wherein multiple foils or colorants are used sequentially, in the preferred embodiment, it is preferable to initially print over the entire image area with clear-abrasion guard, white ink or similar transparent ink to remove an appropriate amount of adhesive from the carrier sheet while leaving adhesive on the entire image area. Then, various colors or half-tone colors can be printed, as necessary. For example, in some instances there will be a physical limit on the smallest amount of adhesive that can be reliably removed by the above-described technique. In those situations, as a first imaging step, a backing material can be applied initially upon which subsequent colors will be printed. Process color half-tone printing techniques, which are employed to generate picture images provide the clearest example of this situation. The small dots of Cyan, Magenta, Yellow, and Black color that are used to generate half-tone images are generally too small to have the adhesive split around them. To circumvent this problem, a backing layer of, usually but not necessarily, white, transparent or clear, is applied over the entire image area. By printing a clear coating over the entire image area, the adhesive is only required to split along the perimeter of the image area rather than along the perimeter of each individual dot used to generate the half-tone image. This technique can also be used to simplify more basic multi-color printing when multiple colors are serially applied to generate a multi-color image, such as in thermal transfer printing, ink jet printing or electrophotographic printing. If a backing layer is first printed over all areas that are to receive any color, the unwanted adhesive may be removed at the beginning of the sign making process. All subsequent printing steps occur in the absence of any exposed adhesive, which simplifies material handling in the printer.

The Adhesive Split Transfer process described above can be also used with printers 18, 118 and 318 to print a durable film image that can be subsequently subjected to the Adhesive Split Transfer process, as mentioned above.

The present invention introduces the concept of the Additive Signmaking Process, as opposed to other known processes of signmaking, such as weeding. The Additive Signmaking Process includes building an image or film onto a substrate. The built up film or image either can be permanently adhered to the substrate or subsequently transferred onto a final substrate. The building up of the image or film can involve either a single layer of developer or multiple layers, including, but not limited to, different colors of developers, clear coating film and/or adhesive. The Additive Signmaking Process has great advantages over the weeding signmaking process. The Additive Signmaking Process eliminates the need for weeding excess material from the sign, thus eliminating waste from the weeding and minimizing potential damage to the actual sign. Use of powder paint and powder toner in signmaking has tremendous advantages. Use of powder paint and powder toner in signmaking yields durable signs capable of being used outdoors.

Although powder paint is well known in some industries, such as automotive, use of powder paint in the signmaking industry has not been known. Similarly, although powder toner has been used in office laser printers and copiers for regular printing operations, powder toner in durable signmaking has not been used.

While the present invention has been illustrated and described with respect to a particular embodiment thereof, it should be appreciated by those of ordinary skill in the art, that various modifications to this invention may be made without departing from the spirit and scope of the present invention. For example, although the printer 118 was described as having a preferred configuration, many other configurations are within the scope of the present invention. Additionally, although the preferred embodiment describes an electrophotographic printer, other types of printers, such as thermal, inkjet, and/or laser, can be used to generate an image and/or durable film image to be used in the Additive Signmaking Process and/or Adhesive Split Transfer Process.

We claim:

1. A method for generating an image product comprising the steps of:

generating an image on a carrier sheet surface, said image having sufficient retention property to releasably remain on said carrier sheet surface;

applying a pressure sensitive adhesive over said carrier sheet surface with said image;

joining said carrier sheet surface with said image and with said pressure sensitive adhesive with a substrate; and removing from said substrate said carrier sheet with excess pressure sensitive adhesive adhered to said surface, leaving said substrate with said image adhered thereto, thereby generating an image product.

2. The method according to claim 1 further comprising an intermediate step of:

applying pressure to ensure attachment of said image with said adhesive onto said substrate prior to removing said carrier sheet with excess adhesive from said substrate and said image.

3. The method according to claim 2 wherein said adhesive has preference for said carrier sheet surface rather than said substrate.

4. The method according to claim 1 wherein said image is reverse printed onto said carrier sheet surface.

5. The method according to claim 1 wherein said adhesive, said carrier sheet surface and said substrate are selected such that said adhesive has preference for said carrier sheet surface rather than said substrate.

6. The method according to claim 1 wherein a bond between said image and said adhesive is stronger than a bond between said image and said carrier sheet surface.

7. The method according to claim 1 wherein a bond between said adhesive and said substrate is stronger than a bond between said image and said carrier sheet surface.

8. The method according to claim 1 wherein a bond between said carrier sheet surface and said adhesive is stronger than a bond between said adhesive and said substrate.

9. The method according to claim 1 wherein said adhesive, said carrier sheet surface and substrate are selected such that a bond between said image and said adhesive is stronger than a bond between said image and said carrier sheet surface, a bond between said adhesive and said substrate is stronger than a bond between said image and said carrier sheet surface, and a bond between said carrier sheet surface and said adhesive is stronger than a bond between said adhesive and said substrate.

10. The method according to claim 1 wherein said film image is printed onto said carrier sheet surface using a laser printer.

11. The method according to claim 1 wherein said film image is printed onto said carrier sheet surface using a thermal printer.

12. The method according to claim 1 wherein said film image is printed onto said carrier sheet surface using an ink jet printer.

13. The method according to claim 1 wherein said film image is printed onto said carrier sheet surface using a silk screening process.

14. The method according to claim 1 wherein said image is a film image.

15. The method according to claim 14 wherein said film image is a durable film.

16. The method according to claim 15 wherein said durable film comprises powder paint.

17. The method according to claim 15 wherein said durable film comprises pigmented resin.

18. The method according to claim 15 wherein said durable film comprises UV curable ink.

19. The method according to claim 1 further comprising a subsequent step of:

curing said substrate with said image to ensure attachment of said image with said adhesive to said substrate.

20. The method according to claim 1 further comprising a step of:

fusing said image onto said substrate.

21. The method according to claim 20 wherein said step of fusing is performed by UV fusing.

22. The method according to claim 20 wherein said step of fusing is performed by heat fusing.

23. The method according to claim 20 wherein said step of fusing is performed by combination of UV and heat fusing.

24. The method according to claim 20 wherein said step of fusing is performed by infrared fusing.

25. The method according to claim 1 wherein said adhesive is applied digitally over said image.

26. The method according to claim 1 wherein said adhesive includes a colorant.

27. The method according to claim 1 wherein said image is comprised of powder paint digitally applied on said carrier sheet.

28. The method according to claim 27 wherein said image becomes a film image upon curing.

29. The method according to claim 28 wherein said film image is a durable film image.

30. The method according to claim 27 wherein said powder paint comprises a resin and pigment.

31. The method according to claim 27 wherein said powder paint comprises resin and pigment and is outdoor durable and UV stable.

32. The method according to claim 1 wherein said image is fused on said carrier sheet before removal to said substrate.

33. The method according to claim 1 wherein said adhesive is applied selectively onto said carrier sheet.

34. The method according to claim 33 wherein said adhesive is applied digitally onto said carrier sheet.

35. The method according to claim 1 wherein said adhesive is applied globally onto said carrier sheet.

36. The method according to claim 35 wherein said adhesive includes a colorant.

37. The method according to claim 1 wherein additional layers of adhesive are digitally applied onto said image.

38. Apparatus for generating an image comprising:

means for applying at least one colorant onto a carrier sheet surface coated with a pressure sensitive adhesive layer to generate an image atop of said pressure sensitive adhesive layer; and means for removing excess pressure sensitive adhesive from said carrier sheet surface to result in said image being disposed atop of said carrier sheet surface with pressure sensitive adhesive being disposed therebetween.

39. The apparatus according to claim 38 further comprising: means for curing said image.

40. The apparatus according to claim 38 further comprising: means for fusing said image.

41. The apparatus according to claim 40 wherein said means for fusing is a non contact fuser.

42. The apparatus according to claim 38 wherein said means for applying at least one colorant is an ink jet system.

43. The apparatus according to claim 38 wherein said means for applying at least one colorant is an electrophotographic system.

44. The apparatus according to claim 38 wherein said means for applying at least one colorant is an electrostatic system.

45. The apparatus according to claim 38 wherein said means for applying at least one colorant is a thermal transfer system.

46. The apparatus according to claim 38 wherein said means for removing said excess adhesive is a system bringing a consumable sheet into contact with said adhesive to remove said excess adhesive leaving said image disposed atop of said carrier sheet with said adhesive layer sandwiched therebetween.

47. The apparatus according to claim 46 wherein said means for removing said excess adhesive comprises:

a supply roll for dispensing said consumable sheet; and a take up roll for taking up said consumable sheet with said excess adhesive disposed thereon.

48. The apparatus according to claim 47 further comprising:

a pressure roller disposed between said supply roll and said take up roll and substantially adjacent to said consumable sheet to apply pressure thereto to promote bonding between said consumable sheet and said excess adhesive.

49. The apparatus according to claim 46 wherein said consumable sheet is ink foil for a thermal transfer printer.

50. The apparatus according to claim 46 wherein said consumable sheet functions as a protective sheet and is removed from said carrier sheet at a later time.

51. The apparatus according to claim 38 further comprising:

means for printing with predetermined background color over an entire image to remove excess adhesives to define an image background perimeter to allow subsequent printing over some portion of said image background perimeter with at least one color to generate a multi-color image.

52. The apparatus according to claim 51 wherein said predetermined background color is white.

53. The apparatus according to claim 51 wherein said predetermined background color is clear.

54. The apparatus according to claim 38 further comprising:

means for printing with predetermined background color over an entire image to remove excess adhesives to define an image background perimeter to allow subsequent printing over some portion of said image background perimeter with at least one half-tone color to generate a half-tone image.

55. A method for generating a film image comprising the steps of:

providing a carrier sheet having a surface with a pressure sensitive adhesive layer removably attached thereto;

printing an image onto said carrier sheet surface with the adhesive layer such that said image is disposed atop of said pressure sensitive adhesive layer; and removing from said carrier sheet surface substantially all excess pressure sensitive adhesive such that said image remains on said carrier sheet surface with said pressure sensitive adhesive layer sandwiched therebetween.

56. The method according to claim 55 wherein said image is printed on a laser printer.

57. The method according to claim 55 wherein powder paint is used to print said image.

58. The method according to claim 55 wherein said image is printed on an ink jet printer.

59. The method according to claim 58 wherein UV cure ink is used to print said image.

60. The method according to claim 55 wherein said image is printed on a thermal transfer printer having an ink foil.

61. The method according to claim 60 wherein said excess adhesive is removed with said ink foil.

62. The method according to claim 61 wherein said excess adhesive adheres to said ink foil.

63. The method according to claim 55 wherein said step of printing further comprises the steps of:

printing with predetermined background color over an entire image to remove excess adhesives to define an image background perimeter; and printing over some portion of said image background perimeter with at least one color to generate a multi-color image.

64. The method according to claim 63 wherein said predetermined background color is white.

65. The method according to claim 55 wherein said step of printing further comprises the steps of:

printing with predetermined background color over an entire image to remove excess adhesives to define an image background perimeter; and printing over some portion of said image background perimeter with at least one half-tone color to generate a half-tone image.

66. The method according to claim 63 wherein said predetermined background color is clear.

67. The method according to claim 66 wherein said colorant is white.

68. The apparatus according to claim 38 further comprising means to apply said adhesive digitally over said carrier sheet.

69. The apparatus according to claim 68 wherein said means to apply adhesive digitally over said carrier sheet is adapted to apply said adhesive globally.

70. The apparatus according to claim 68 wherein said means to apply adhesive digitally over said carrier sheet is adapted to apply said adhesive selectively so as to at least cover substantially the portion within the boundaries of a predetermined image to be applied.

71. The apparatus according to claim 38 wherein said colorant includes dye.

72. The apparatus according to claim 38 wherein said colorant includes pigment.

73. The method according to claim 55 wherein said adhesive is digitally applied over said carrier sheet.

74. The method according to claim 55 wherein said digital application of said adhesive is global.

75. The method according to claim 55 wherein said digital application of said adhesive is selective so as to at least cover substantially the portion within the boundaries of a predetermined image to be applied.

76. Apparatus for generating an image comprising:

means for applying at least one colorant onto a carrier sheet surface coated with a pressure sensitive adhesive layer to generate an image atop of said adhesive layer, said adhesive layer containing at least one colorant; and means for removing excess adhesive from said carrier sheet surface to result in said image being disposed atop of said carrier sheet surface with adhesive being disposed therebetween.

77. A method for generating a film image comprising the steps of:

providing a carrier sheet surface with a layer of pressure sensitive adhesive containing at least one colorant;

printing an image onto said carrier sheet surface with said adhesive layer such that said image is disposed atop of said adhesive layer; and removing from said carrier sheet substantially all excess adhesive such that said image remains on said carrier sheet with said adhesive layer sandwiched therebetween.

78. A method for generating an image product comprising the steps of:

generating an image on a carrier sheet surface, said image having sufficient retention property to releasably remain on said carrier sheet surface;

applying a pressure sensitive adhesive to cover said image with at least one adhesive layer, and areas outside of said image with excess adhesive;

joining said carrier sheet surface with said image and with said adhesive with a substrate; and removing from said substrate said carrier sheet surface with substantially all of said excess adhesive, leaving said substrate with said image adhered thereto, thereby generating an image product.

79. A method for generating an image product comprising the steps of:

generating an image with a curable medium on a carrier sheet surface;

curing said image;

applying an adhesive to cover said cured image with a pressure sensitive adhesive layer, and areas outside of said image with excess adhesive;

heating a thermoplastic transfer film to a softened or tacky state, said adhesive and said transfer film being selected such that said adhesive has a preference for said carrier sheet surface rather than said transfer film;

joining said carrier sheet surface with said cured image and with said adhesive with said heated transfer film;

permitting said transfer film to cool to a hard, durable state; and removing said carrier sheet surface with excess adhesive from said transfer film, leaving said transfer film with said image adhered thereto, thereby generating an image product.

80. A method for generating an image product in a printing apparatus comprising the steps of:

generating an image on a carrier sheet surface having a pressure sensitive adhesive layer disposed thereon;

joining said carrier sheet with said image and with said adhesive with a consumable sheet; and removing said consumable sheet with excess adhesive from said carrier sheet surface, leaving said carrier sheet with said image adhered thereto, thereby generating an image product.

81. Apparatus for generating an image comprising:

means for applying at least one colorant onto a carrier sheet surface digitally coated with a pressure sensitive adhesive layer to generate an image atop of said adhesive layer;

means for joining said carrier sheet with said image and with said adhesive in contact with a consumable sheet; and means for removing said consumable sheet with excess adhesive from said carrier sheet surface to result in said image being disposed atop of said carrier sheet with said adhesive being disposed therebetween.

82. Image product according to claim 81 wherein said adhesive layer is digitally applied selectively to said substrate.

83. Image product according to claim 82 wherein said adhesive is digitally applied globally onto said substrate.

84. Apparatus for generating an image comprising:

means for digitally applying a layer of pressure sensitive adhesive onto a carrier sheet surface;

means for applying at least one colorant onto said carrier sheet surface coated with said adhesive layer to generate an image atop of said adhesive layer; and a device for bringing a consumable sheet in face-to-face contact with said carrier sheet, and for removing said consumable sheet therefrom, said consumable sheet and said adhesive being selected such that said adhesive has a preference for said consumable sheet rather than said carrier sheet surface to facilitate removal of excess adhesive from said carrier sheet along with said consumable sheet, to result in said image being disposed atop of said carrier sheet with adhesive being disposed therebetween.

85. The apparatus according to claim 84 wherein said adhesive contains a colorant.

86. The apparatus according to claim 85 wherein said colorant is white.

87. Apparatus for generating an image comprising:

a device for applying a pressure sensitive adhesive layer containing a colorant onto a carrier sheet surface;

means for applying at least one colorant including at least one of a powder paint and powder toner onto said carrier sheet surface coated with said adhesive layer to generate an image atop of said adhesive layer; and a device for bringing a consumable sheet in contact with said carrier sheet for removing excess adhesive from said carrier sheet surface to result in said image being disposed atop of said carrier sheet with adhesive being disposed therebetween.

88. Image product produced according to a method for generating an image product comprising the steps of:

generating an image on a carrier sheet surface, said image having sufficient retention property to releasably remain on said carrier sheet surface;

applying a pressure sensitive adhesive over said carrier sheet surface with said image;

joining said carrier sheet with said image and with said adhesive with a substrate, said substrate and said adhesive being selected such that said adhesive has a preference for said carrier sheet surface rather than said substrate; and removing from said substrate said carrier sheet surface with excess adhesive adhered thereto, leaving said substrate with said image adhered thereto.

89. Image product produced according to a method for generating an image product comprising the steps of:

applying at least one colorant onto a carrier sheet surface coated with a pressure sensitive adhesive layer to generate an image atop said adhesive layer; and removing excess adhesive from said carrier sheet surface to result in said image being disposed atop of said carrier sheet surface with adhesive being disposed therebetween.

90. Image product produced according to a method for generating an image product comprising the steps of:

generating an image on a carrier sheet surface having a pressure sensitive adhesive layer disposed thereon;

joining said carrier sheet with said image and with said adhesive with a consumable sheet; and removing said consumable sheet with excess adhesive from said carrier sheet surface, leaving said carrier sheet with said image adhered thereto.

* * * * *

UNITED STATES PATENT AND TRADEMARK OFFICE

CERTIFICATE OF CORRECTION

PATENT NO. : 6,957,030 B2
DATED : October 18, 2005
INVENTOR(S) : Peter R. Baker, Jr. et al.

It is certified that error appears in the above-identified patent and that said Letters Patent is hereby corrected as shown below:

Title page,
Item [73], Assignee, should read -- Gerber Scientific International, Inc.
South Windsor, Connecticut (USA) --.

Signed and Sealed this

Twenty-fourth Day of January, 2006

JON W. DUDAS
*Director of the United States Patent and Trademark Office*